US005235908A

United States Patent [19]

Froelicher et al.

[11] Patent Number: 5,235,908

[45] Date of Patent: Aug. 17, 1993

[54] APPARATUS FOR MAKING STENCILS FOR USE IN SCREEN PRINTING MACHINES

[75] Inventors: René Froelicher, Mutschellen; Peter Wendel, Würenlos, both of Switzerland

[73] Assignee: Beuteltuchfabrik AG Züricher, Rüschlikon, Switzerland

[21] Appl. No.: 995,360

[22] Filed: Dec. 22, 1992

Related U.S. Application Data

[63] Continuation of Ser. No. 738,466, Jul. 31, 1991, abandoned.

[30] Foreign Application Priority Data

Aug. 6, 1990 [CH] Switzerland ..... 02560/90

[51] Int. Cl.[5] ..... B41F 15/36

[52] U.S. Cl. ..... 101/127.1; 101/128.4

[58] Field of Search ..... 101/127.1, 128.1, 128, 101/415.1, 128.4, 407.1, 408, 474, 378; 269/25, 26, 27, 28, 30, 31, 32, 33, 34; 38/102.5, 102.6, 102.7, 102.8, 102.9, 102.91; 156/494, 496, 229

[56] References Cited

U.S. PATENT DOCUMENTS

| | | | |
|---|---|---|---|
| 2,546,458 | 3/1951 | Launder | 269/31 X |
| 3,391,635 | 7/1968 | Matheus | 101/127.1 |
| 3,541,957 | 11/1970 | Bubley | 101/127.1 |
| 4,442,772 | 4/1984 | Bubley | 101/127.1 |
| 4,978,414 | 12/1990 | Ohtani et al. | 101/127.1 |

*Primary Examiner*—J. Reed Fisher
*Attorney, Agent, or Firm*—Peter K. Kontler

[57] ABSTRACT

Apparatus for making stencils of the type having a rectangular frame and a woven fabric stretched upon and affixed to the frame for use in a screen printing machine has a table which supports four rows of neighboring fabric stretching devices surrounding a rectangular portion of the upper side of the table. Each stretching device has a support the underside of which abuts the upper side of the table, and a double-acting hydraulic or pneumatic cylinder and piston unit pivoted to the support and having a piston rod extendable toward and retractable away from the frame at the rectangular portion of the upper side of the table. The free end of each piston rod carries tongs having a pair of fabric-engaging jaws which stretch the fabric during retraction of the respective piston rod.

22 Claims, 3 Drawing Sheets

3
4
5
7
1
2
6
24
21
23
10a
9
27
11
8
22
27
20
25
19
10
12
18
14
13
17
28
16
29
32
15
36'
30
31
34'
36
34
32
31

3
5
6
1
33
21
26
A
A
M2
M1
16
31
32
31

APPARATUS FOR MAKING STENCILS FOR USE IN SCREEN PRINTING MACHINES

CROSS-REFERENCE TO RELATED APPLICATION

This is a continuation of commonly owned patent application Ser. No. 07/738,466 filed Jul. 31, 1991, now abandoned.

BACKGROUND OF THE INVENTION

The invention relates to the art of screen printing in general, and more particularly to improvements in apparatus for making screens or stencils for use in screen printing machines. Still more particularly, the invention relates to improvements in apparatus for stretching woven or other suitable fabrics over the frames of screens or stencils of the type suitable for use in screen printing machines.

Screen printing is resorted to in a number of different fields, particularly in fields where the application of a design or pattern upon a substrate must be carried out with a very high degree of precision. Typical examples of such substrates are printed circuit boards to which a design must be applied with tolerances of not more than 0.05 mm. The mesh of the fabric must be maintained within tolerances in the range of one or more thousandths of one millimeter.

The making of a stencil or screen which is suitable for use in connection with the making of printed circuit boards and in other fields wherein a high degree of precision is equally or even more important necessitates highly uniform and predictable stretching of a fabric (such fabrics are often woven from silk, polyester, nylon or stainless steel) upon a normally rectangular frame which can be made of wood, aluminum or other suitable material. Even minor distortions which are attributable to non-uniform stretching of the fabric will render the thus obtained stencils useless for their intended purpose because the tolerances will exceed those which are acceptable in connection with the application of printed matter to printed circuit boards and like substrates.

Another requirement which must be met by a stencil for the application of printing ink to a printed circuit board or another substrate which is to be imprinted with the same or with an even higher degree of accuracy is that the filaments of the fabric be stretched by the application of forces which are much larger than those required in connection with the making of many heretofore known stencils. Thus, not only the uniformity of stretching action but also the magnitude of the force which is applied to ensure a uniform stretching action must greatly exceed the degree of uniformity and the magnitude of forces which can be achieved and applied by resorting to heretofore known techniques. The application of larger stretching forces can be achieved only by further enhancing the uniformity of the stretching action because any, even slight, departures from uniform stretching would result in breakage of filaments as soon as the applied force reaches a value which is still below the desired optimum value. In other words, an apparatus which meets the above in part contradictory requirements must be designed to ensure the establishment of a highly uniform stretching action while, at the same time, permitting the application of forces much greater than those which are normally applied in accordance with heretofore known techniques. The presently available stencil making and fabric stretching apparatus cannot satisfy the above requirements.

OBJECTS OF THE INVENTION

An object of the invention is to provide a novel and improved apparatus for the making of stencils which are capable of being put to use in screen printing machines for the application of patterns with a high degree of accuracy.

Another object of the invention is to provide an apparatus which is constructed and assembled in such a way that it can be used in connection with the stretching of fabrics upon larger or smaller frames.

A further object of the invention is to provide an apparatus which can stretch a fabric with a higher degree of uniformity than heretofore known apparatus.

An additional object of the invention is to provide an apparatus which can be used to stretch a fabric with a high degree of uniformity and to subject the filaments of the stretched fabric to tensional stresses which are more pronounced than those achievable in heretofore known apparatus.

Still another object of the invention is to provide a novel and improved method of making stencils for use in screen printing machines, for example, in machines for the application of patterns to blanks for the making of circuit boards.

A further object of the invention is to provide novel and improved fabric stretching or tensioning devices which can be put to use in the above outlined apparatus.

Another object of the invention is to provide simple, compact and inexpensive stretching or tensioning devices which can be assembled to constitute or to form part of the above outlined apparatus.

An additional object of the invention is to provide stretching devices which can be assembled in such a way that they can stretch and tension each and every portion of a fabric with a selected force to thus prevent tearing of filaments and/or other defects which would render the thus obtained stencils useless for their intended purpose.

A further object of the invention is to provide the apparatus with novel and improved means for locating the frame of a stencil during stretching of a fabric upon the properly located frame.

SUMMARY OF THE INVENTION

One feature of the present invention resides in the provision of a device for stretching a fabric, e.g., a woven fabric, upon a frame (such as a rectangular metallic frame) for use in a screen printing machine. The improved stretching device comprises a support (e.g., an elongated support consisting of a metallic material), and a fluid-operated (hydraulic or pneumatic) motor having a cylinder, a piston rod reciprocably extending into the cylinder and means (such as a system of valves and a piston which is reciprocable in the cylinder and is connected to the piston rod) for moving the piston rod in at least one direction, namely in a direction to draw the piston rod into the cylinder of the fluid-operated motor. The stretching device further comprises means for securing the cylinder to the support and tongs carried by and being reciprocable with the piston rod externally of the cylinder and including first and second fabric-engaging jaws. The underside of the support preferably constitutes a supporting surface which permits predictable positioning of the support on the upper side of a table or another suitable holder in an apparatus wherein the improved stretching device is put to use.

The piston rod extends from one end portion of the cylinder, and the second end portion of the cylinder is connected to the support by the aforementioned securing means, preferably in such a way that the securing means defines for the motor a pivot axis which is at least substantially normal to the axis of the piston rod and is parallel or nearly parallel to the supporting surface or underside of the support.

The piston rod is reciprocable (with the tongs) between a retracted position and an extended position, and the stretching device preferably further comprises a base or anvil which supports the tongs from below in the extended position of the piston rod. Such base is preferably rigid with and can constitute an integral or separately produced part of the support. The top surface of the base preferably includes a portion which slopes toward the supporting surface or underside of the support in a direction toward the cylinder of the fluid-operated motor. The top surface of the base confronts a surface of the tongs, and such confronting surfaces can be provided with complementary or otherwise cooperating combined guiding and centering means to guide and center the tongs during movement of the piston rod toward its extended position.

It is preferred to provide a universal joint between the piston rod and the tongs.

The first jaw can be provided with a first fabric-engaging portion (e.g., a pad) having a first elasticity, and the second jaw can be provided with a second fabric-engaging portion (e.g., in the form of a liner or pad) having a greater second elasticity. The stretching device further comprises means for opening and closing the tongs, and the first fabric-engaging portion is preferably provided with at least one projection (e.g., in the form of a single elongated rib or two or more preferably parallel ribs) which deforms the second fabric-engaging portion in response to closing of the tongs to thus ensure reliable clamping engagement of the jaws with a piece of fabric between them.

Each of the jaws can be provided with two substantially parallel lateral marginal portions which make oblique angles with the axis of the piston rod. It is presently preferred to employ a pair of overlapping jaws which have substantially rhomboidal outlines.

The support is preferably provided with a first frame carrier which can constitute an integral or a separately produced detachable or permanently affixed part of the support. The tongs are located between the first carrier and the securing means for the fluid-operated motor, at least in the extended position of the piston rod. The carrier can include means (e.g., a pair of properly oriented surfaces) for locating a frame preparatory to stretching of a fabric by the jaws of the tongs in response to movement of the piston rod toward the retracted position. A mobile second frame carrier can be provided to cooperate with the first carrier in order to maintain a frame in an optimum position relative to the support during stretching of the fabric. The second carrier can be movably mounted on or in the support, and the stretching device preferably comprises means for releasably affixing the second carrier to the support in any one of a number of different positions relative to the first carrier, depending upon the dimensions and/or configuration of the frame which is to be held by the first and second carriers.

The locating means of the first carrier is preferably positioned at a first distance from (normally above) the supporting surface or underside of the support, and the two jaws of the tongs (in closed position of the tongs) meet in a plane which is located at a lesser second distance from the supporting surface when the tongs rest on the aforementioned base in the extended position of the piston rod.

Another feature of the invention resides in the provision of an apparatus for making stencils of the type having a frame and a stretched fabric mounted on the frame for controlled penetration of ink in a screen printing machine. The apparatus comprises a holder (e.g., in the form of a table or counter) having an upper side, and a plurality of stretching devices mounted at and surrounding a preferably rectangular frame-receiving portion of the upper side of the holder. The supporting surfaces or undersides of the stretching devices abut the upper side of the holder, and each such stretching device can be constructed, assembled and operated in a manner as outlined hereinbefore.

The stretching devices on the holder include at least two neighboring stretching devices, and the jaws of the tongs of the at least two neighboring stretching devices preferably include immediately adjacent lateral marginal portions which, as already explained hereinbefore, can make oblique angles with the axes of the respective piston rods. The apparatus can further comprise means for maintaining the supports of the stretching devices in predetermined positions with reference to the holder so that the tongs are adjacent the aforementioned portion of the upper side of the holder in the extended positions of the respective piston rods.

The stretching devices can be arrayed to form plural rows including two pairs of parallel rows which surround the preferably rectangular frame-receiving portion of the upper side of the holder.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
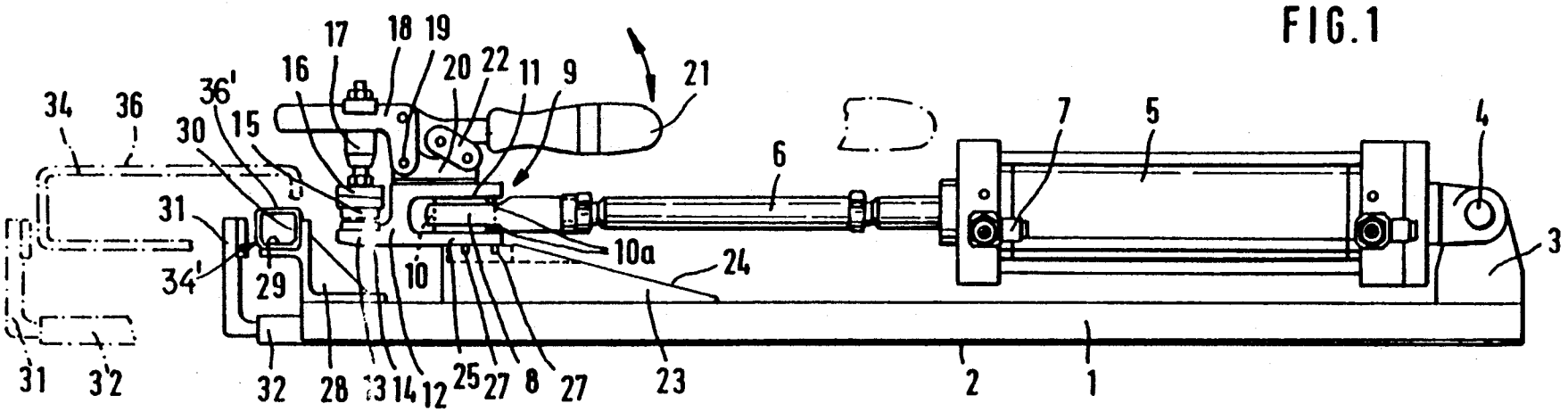
FIG. 1 is an elevational view of a single stretching device, the piston rod of the fluid-operated motor being shown in the extended position and the tongs at the free end of the piston rod being closed and resting on the base of the support, a first frame being shown in the locating means of the first frame carrier, and a portion of a second frame being shown in a position the second frame occupies when it engages the locating means of the first carrier, the second frame carrier being shown in two different positions.
Figure 2:
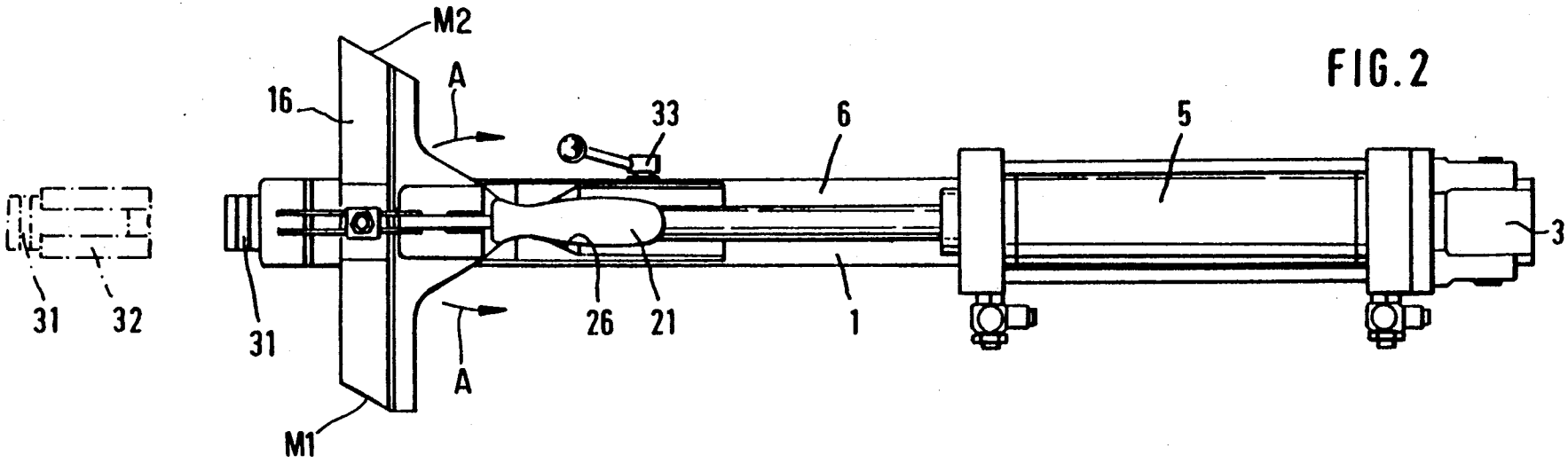
FIG. 2 is a plan view of the stretching device which is shown in FIG. 1.
Figure 3:
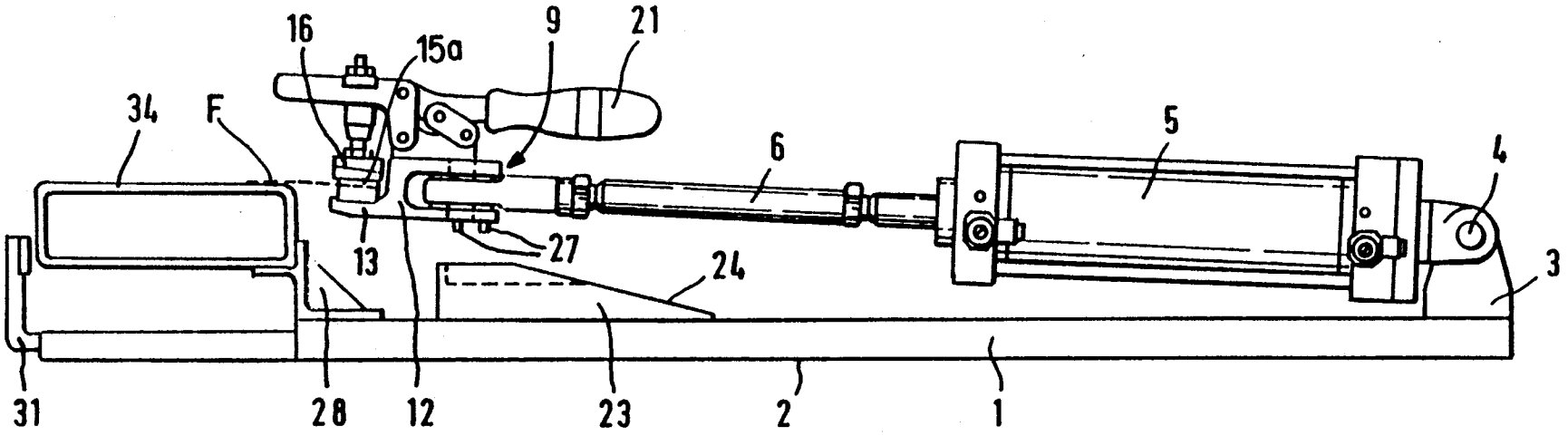
FIG. 3 shows the structure of FIG. 1 but with the tongs in the process of stretching a portion of a fabric upon a frame which engages the locating means of the first carrier.
Figure 4:
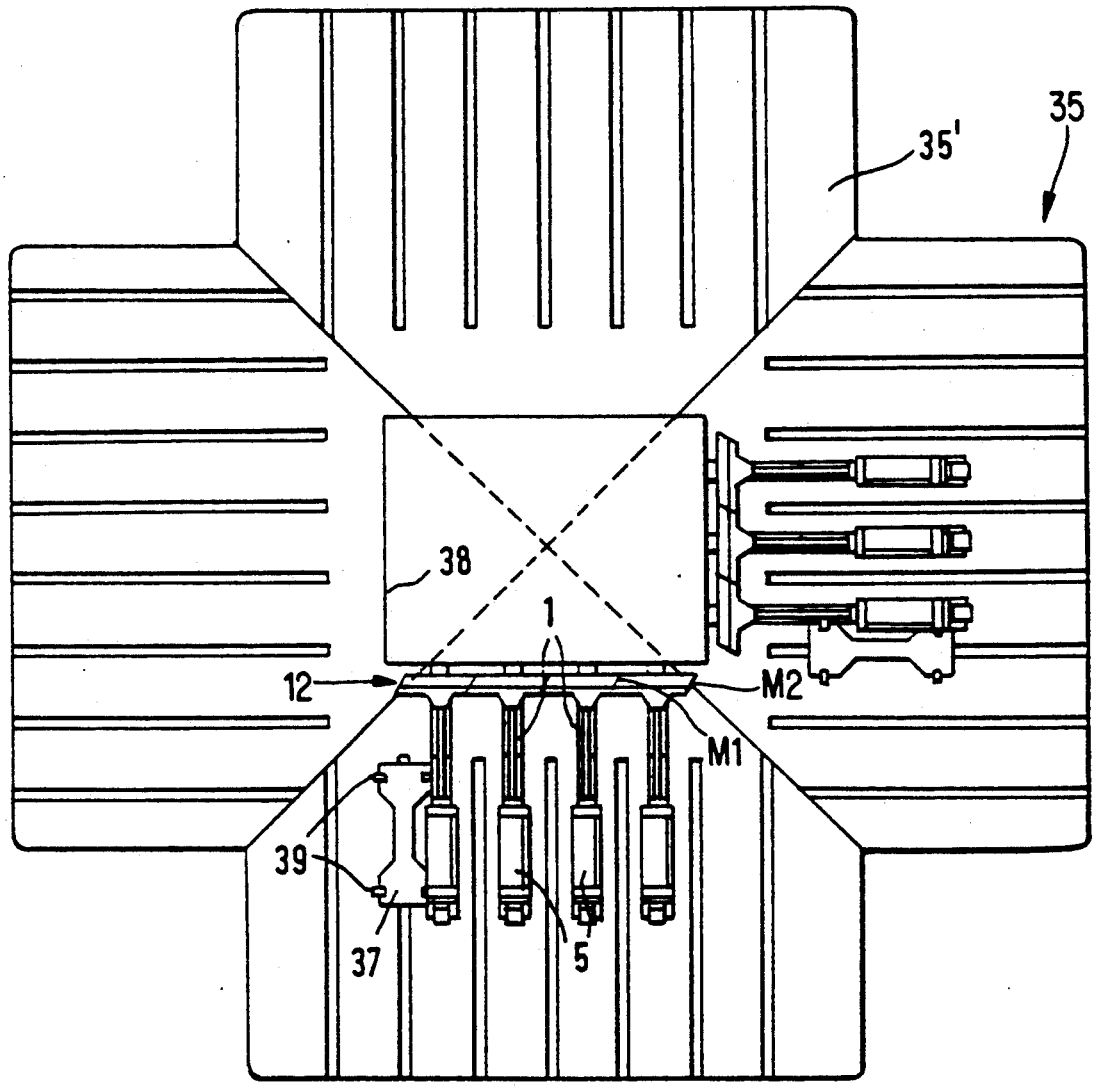
FIG. 4 is a plan view of an apparatus which employs four rows of stretching devices of the type shown in FIGS. 1 to 3.

Referring first to FIGS. 1 to 3, there is shown a stretching or tensioning device which can be utilized in an apparatus of the type shown in FIG. 4 in order to stretch a fabric F (e.g., a woven fabric) upon a suitable frame 34 or 34' forming part of a stencil for use in a screen printing machine. FIG. 1 shows in a schematic cross-sectional view a portion of a relatively small rectangular frame 34' and a portion of a larger frame 34 which latter can be properly positioned relative to the stretching device upon removal of the smaller frame 34' (see FIG. 3).

The stretching device of FIGS. 1 to 3 comprises an elongated support 1 which can constitute a length of rail and has a plane underside or supporting surface 2 serving to abut the upper side or top surface 35' of a holder 35 here shown in FIG. 4 in the form of a cruciform table and forming a stationary part of the stencil assembling apparatus. The support 1 mounts a fluid-operated motor, preferably a hydraulically or pneumatically operated double-acting cylinder and piston unit having a cylinder 5 and an elongated piston rod 6 extending from the left-hand end portion of the cylinder 5. The right-hand end portion of the cylinder 5 has one or more lugs forming part of a coupling 3 which secures the fluid-operated motor to the support 1 and defines for the cylinder 5 a pivot axis (note the pivot member 4) which extends at right angles to the axis of the piston rod 6 and is parallel to the underside or supporting surface 2. The free end portion of the piston rod 6 is connected with tongs 12 by a universal joint 9. The character 7 denotes one of the components of the means for moving the piston rod 6 relative to the cylinder 5. Such moving means includes a piston (not specifically shown) which is connected to the piston rod 6 in the interior of the cylinder 5, a source of pressurized hydraulic or pneumatic fluid and conduits and valves which serve to admit pressurized fluid into the chamber between the piston and the left-hand end wall or into the chamber between the piston and the right-hand end wall of the cylinder. The exact construction of the non-illustrated portions of the means for moving the piston rod 6 relative to the cylinder 5 forms no part of the present invention. As mentioned above, the cylinder and piston unit which is mounted on the support 1 is preferably a double-acting unit; however, it suffices under certain circumstances to design the motor in such a way that the piston rod 6 can be moved from an extended position (shown in FIGS. 1 and 2) toward a retracted position, i.e., in a direction to penetrate deeper into the cylinder 5 and to move the tongs 12 nearer to the securing means or coupling 3.

The universal joint 9 between the left-hand end of the piston rod 6 and the tongs 12 comprises a ring 8 which can constitute an integral part of the piston rod and surrounds a partly spherical element 10 which can swivel and otherwise move therein about a plurality of crossing axes. The spherical element 10 is coaxial with and is affixed to a shaft 11 which is mounted in the bifurcated rear (left-hand) portion of the tongs 12. One prong of such bifurcated portion is located above and the other prong is located beneath the partly spherical element 10. The tongs 12 can swivel with the element 10 relative to the ring 8 and can also turn relative to the ring 8 about the axis of the shaft 11 (note the arrows A in FIG. 2). Elastic washers **10*a* surround the shaft 11; one of these washers is located between the upper side of the ring 8 and the underside of the upper prong of the bifurcated portion of the tongs 12, and the other elastic washer 10*a* is installed between the lower prong and the underside of the ring 8. The washers 10*a* tend to maintain the tongs 12 in a preselected angular position. The washers 10*a* further enable the shaft 11 to perform limited axial movements relative to the ring 8**.

The tongs 12 comprise a fixed lower jaw 13 which is rigid with the aforementioned bifurcated rear portion, and an upper jaw 16 which is pivotable relative to the jaw 13 between an open position (not shown) and a closed position which is shown in FIGS. 1 and 3. The lower jaw 13 includes a fabric-engaging portion 14 in the form of a pad which confronts a similar fabric-engaging portion or pad 15 of the upper jaw 16. The material of the pad 14 is at least slightly elastic, and the material of the upper pad 15 is less elastic. This ensures that, when the tongs 12 are closed, one or more projections **15*a* at the underside of the upper pad 15 penetrate into and deform the lower pad. The projections 15*a* can constitute elongated parallel ribs which extend substantially transversely of the axis of the piston rod 6 and ensure that a marginal portion of the fabric F is reliably gripped by the jaws 13, 16 when the tongs 12 are closed and the projections 15*a*** form corrugations in the adjacent portion of the fabric.

The material of the upper pad 15 can have a Shore hardness of 95, and the material of the lower pad 14 can have a Shore hardness of 75. Other ratios of hardnesses or elasticities of the materials of the pads 14, 15 can be selected in dependency upon the nature of the fabric F and on the desired extent of tensional stress upon the filaments of the fabric in the course of the stretching operation, i.e., while the pads 14, 15 grip a portion of the fabric F and the piston rod 6 is caused to move the tongs 12 toward the cylinder 5. It can be said that the projections or ribs **15*a* ensure the establishment of a form-locking and force-locking connection between the gripped portion of the fabric F on the one hand and the pads 14, 15 of the jaws 13, 16 of closed tongs 12** on the other hand.

The means for pivoting or reciprocating the upper jaw 16 toward and away from the lower jaw 13 (in order to close and open the tongs 12) comprises a threaded connector 17 which secures the upper jaw 16 to one arm of a bell crank lever 18. The other arm of the lever 18 is articulately connected to a bearing member 20 by a substantially horizontal pivot member 19, and the bearing member 20 is fixedly secured to the upper prong of the bifurcated rear portion of the tongs 12, i.e., the bearing member 20 is or can be rigid with the fixed lower jaw 13. The bell crank lever 18 can be rocked about the axis of the pivot member 19 by a toggle mechanism including a handle 21 and a link 22. When the handle 21 is pivoted in a clockwise direction (as viewed in FIGS. 1 or 3), it causes the link 22 to move toward, through and beyond a dead-center position to firmly lock the tongs 12 in the closed position in which the pads 14, 15 properly engage and prevent slippage of the fabric portion between the jaws 13 and 16. Pivoting of the handle 21 in a counterclockwise direction must be carried out with a force which suffices to move the link 22 toward, through and beyond the dead-center position and to thus open the tongs 12 upon completion of a fabric stretching operation.

As can be seen in FIG. 2, the lateral marginal portions M1 and M2 of the jaws 13, 16 and their respective pads 14, 15 make oblique angles with the axis of the piston rod 6. This is desirable and advantageous because the illustrated tongs 12 can be positioned immediately adjacent and between similar tongs of two neighboring stretching devices to thus ensure uniform stretching of each and every filament of a fabric F which is in the process of being stretched upon a frame 34 or 34'. The lateral marginal portions M1 and M2 of the jaws 13 and 16 and of their respective pads 14, 15 are preferably parallel to each other. FIG. 2 shows that the jaws of the tongs 12 have a substantially rhomboidal outline.

The stretching device further comprises a base or anvil 23 which can constitute an integral or detachable part of the support 1 and is remote from the cylinder 5 and securing means 3. The upper side or top surface of the base 23 includes a right-hand portion 24 which slopes toward the underside or supporting surface 2 in a direction toward the cylinder 5, and a left-hand portion 25 which is or can be parallel to the supporting surface 2. The stationary or fixed jaw 13 and/or the bifurcated rear portion of the tongs 12 comes to rest upon the portion 25 of the top surface 24+25 of the base 23 when the piston rod 6 is moved to the extended position of FIGS. 1 and 2.

The underside or bottom surface of the tongs 12 and the top surface 24+25 of the base 23 are provided with combined guiding and centering means for the tongs 12. Such combined guiding and centering means is operative during movement of the piston rod 6 toward the extended position of FIG. 1 to ensure that the lower jaw 13 is then maintained in an optimum position for the placing of a marginal portion of a fabric F over the upper side of the lower pad 14 before the handle 21 is pivoted in a direction to close the tongs 12. The illustrated combined guiding and centering means comprises a recess 26 which is provided in the sloping portion 24 of the top surface of the base 23 and narrows in a direction toward the surface portion 25. The leftmost part of the recess 26 can extend into the surface portion 25, e.g., through a distance of one or more millimeters. The combined guiding and centering means further comprises followers in the form of pins 27 which extend from the bottom surface of the tongs 12 and slide in the recess 26 during movement of the piston rod 6 toward its extended position. At such time, the gradually narrowing portion of the recess 26 ensures that the tongs 12 invariably assume a predetermined position relative to the base 23 as soon as the movement of the piston rod 6 to its extended position is completed. That portion of the recess 26 which extends into the surface portion 25 can have a constant width, and the surfaces flanking such portion of the recess 26 are engaged by the pins 27 when the piston rod 6 reaches the extended position of FIG. 1. Other types of combined guiding and centering means can be used with equal or similar advantage. For example, the pins 27 can be provided on the base 23 to extend into a recess in the bottom surface of the tongs 12. Proper positioning of the tongs 12 is of considerable importance because the stretching device of FIGS. 1 to 3 is used with several additional stretching devices (see FIG. 4) to engage neighboring marginal portions of a fabric F preparatory to and in the course of a stretching operation. Proper positioning of neighboring tongs 12 relative to each other ensures that each and every part of each marginal portion of a fabric F is gripped by a pair of jaws 13, 16 during stretching of the fabric.

The cylinder 5 turns about the axis of the pivot member 4 during movement of the piston rod 6 toward its extended position, namely during that stage of such movement of the piston rod when the bottom surface of the tongs 12 reaches and begins to move upward along the sloping right-hand portion 24 of the top surface 24+25 of the base 23.

The left-hand end portion of the elongated support 1 is integral with or is permanently or separably connected with a stationary first carrier 28 for a frame 34 or 34'. This carrier has two mutually inclined surfaces 29, 30 which constitute a means for locating the frame 34 or 34' in an optimum position for the stretching of a fabric F over its upper side 36 or 36'. The illustrated surface 29 is parallel with and the illustrated surface 30 is normal to the supporting surface 2 of the support 1.

A movable substantially L-shaped second frame carrier 31 is mounted on a reciprocable bar or rod 32 which is slidable in and longitudinally of the support 1. The latter carries a conventional locking or affixing member 33 (FIG. 2) which can releasably maintain the mobile second carrier 31 in any one of a number of different positions so that the carriers 28, 31 cooperate in order to hold a frame 34 or 34' in an optimum position for the stretching of a fabric F over its upper side 36 or 36'. A portion of a properly positioned frame 34 or 34' rests on the locating surface 29 and is urged against or merely kept in contact with the locating surface 30 by the mobile second carrier 31.

The level of the locating surface 29 on the first carrier 28 (namely the distance of the locating surface 29 from the supporting surface 2) is selected in such a way that the distance of the upper side 36 or 36' of a properly located frame 34 or 34' from the supporting surface 2 invariably exceeds the distance of the supporting surface 2 from the plane where the pads 14, 15 meet when the tongs 12 are closed and rest on the surface portion 25 of the base 23. This prerequisite is satisfied irrespective of the height of the selected frame, i.e., irrespective of the distance of the locating surface 29 from the upper side 36' of a relatively low frame 34' or of the locating surface 29 from the upper side 36 of a much higher frame 34 (while the frame rests on the surface 29). This ensures that, during stretching of a fabric F, the tongs 12 are lifted off the base 23 in that the pins or followers 27 are lifted above the recess 26 (see FIG. 3) because the fluid-operated motor including the cylinder 5 turns in a clockwise direction about the axis of the pivot member 4 of the securing means 3. Due to lifting of the tongs 12 above and away from the base 23, the universal joint 9 is effective to permit universal movements of the jaws 13, 16 (the tongs 12 are then closed) relative to the adjacent free end of the piston rod 6. This, in turn, ensures highly uniform tensioning of all filaments of that portion of the fabric F which is clamped between the pads 14 and 15, i.e., the stretching action is uniform across the full width of the tongs 12.

FIG. 4 shows the top surface 35' of the cruciform table or holder 35 of the stencil forming apparatus which includes four rows of neighboring stretching devices of the type shown in FIGS. 1 to 3. The four rows include two pairs of parallel rows which jointly surround a rectangular portion 38 of the top surface 35'; such rectangular portion serves to receive a frame 34 or 34' (not shown in FIG. 4) in the course of a fabric stretching and subsequent fabric affixing operation in order to assemble the fabric and the frame into a stencil. Each of the two longer rows comprises seven stretching devices, and each shorter row comprises six stretching devices. The undersides or supporting surfaces 2 of the supports 1 of all stretching devices abut the adjacent portions of the top surface 35'. The number of stretching devices depends on the dimensions of the holder 35 as well as on the dimensions of the frame which is to be located above the rectangular portion 38 of the top surface 35'. Each stretching device of any given row is aligned with a stretching device of the respective parallel row, and the supports 1 of neighboring stretching devices in any given row are parallel to and can be closely adjacent each other.

As can be seen in FIG. 4, the lateral marginal portions M1, M2 of the jaws of tongs 12 of neighboring stretching devices in any given row are immediately adjacent each other to thus ensure that each and every filament of a fabric F which is to be stretched is properly engaged by the jaws of one or two tongs. Those filaments which cross the marginal portions M1, M2 of two neighboring pairs of jaws are clamped and tensioned in the same way as those filaments which are clamped and tensioned only by the jaws of one tongs 12.

The table or holder 35 is furnished with several locating or positioning units 37 for the supports 1. The positioning units 37 are adjustably mounted on the holder 35 and have pairs of protuberances 39 which enter complementary recesses of neighboring supports 1 to ensure proper positioning of such supports on the top surface 35'. The configuration and mounting of the protuberances 39 are preferably such that a properly mounted positioning unit 37 can reliably maintain the supporting surface 2 of a single support 1 or the supporting surfaces of two neighboring supports in abutment with the adjacent portion or portions of the top surface 35' to thus ensure that the stretching devices remain in selected optimum positions relative to the rectangular portion 38 of the top surface 35' during stretching of a fabric F upon a frame (such as 34 or 34') which is in abutment with the locating surfaces 29, 30 of carriers 28 of all stretching devices which participate in a stretching operation.

The operation of the apparatus of FIG. 4 is as follows:

The first step involves admission of pressurized fluid into those chambers of the cylinders 5 which are adjacent the respective securing means 3, i.e., the piston rods 6 are caused to move toward their extended positions whereby the tongs 12 slide along and are centered by the respective bases 23 to assume positions corresponding to that of the tongs 12 shown in FIGS. 1 and 2. The locking or affixing means 33 are thereupon actuated to release the respective rods or bars 32 so that the second frame carriers 31 can be moved away from the associated supports 1 to optimum positions for the placing of portions of a frame 34 or 34' onto the locating surfaces 29 of the first carriers 28. The carriers 31 maintain such frame in abutment with the locating surfaces 30 of the first carriers 28. The tongs 12 are open so that the gaps between the pairs of pads 14, 15 can receive portions of a fabric F which is to be stretched upon the upper side 36 or 36' of the frame 34 or 34' resting on the locating surfaces 29 and abutting the locating surfaces 30. Adjustments of the mobile carriers 31 relative to the respective supports 1 can be facilitated by providing the parts 32 with suitably calibrated scales (not shown) which are movable along pointers or markers on the respective supports 1. The locking means 33 are actuated again as soon as the mobile carriers 31 reach the selected positions in order to ensure that the carriers 31 are safely locked in the newly selected positions at optimum distances from the respective locating surfaces 30. The locking means 33 can be actuated to fix the parts 32 in selected positions prior or subsequent to placing of a frame 34 or 34' onto the locating surfaces 29 of the first carriers 28.

Opening of the tongs 12 in response to manipulation of the respective handles 21 can take place after a selected frame 34 or 34' has been deposited on the locating surfaces 29 if the fabric F is yet to be placed over the upper side 36 or 36' of the selected frame 34 or 34'. This ensures that the marginal portions of the fabric F can enter the gaps between the pairs of pads 14, 15 before the handles 21 are manipulated again to close the respective tongs 12 and to thus clamp the marginal portions of the fabric F between the pairs of pads 14, 15 all the way around the rectangular portion 38 of the top surface 35' of the holder 35. Closing of the tongs 12 can be carried out in a predetermined sequence, for example, first the tongs of one long row, thereupon the tongs of the other long row, thereafter the tongs of one short row and finally the tongs of the other short row.

The next step involves admission of pressurized fluid into those chambers of the cylinders 5 which are remote from the respective pivot members 4. This causes a movement of the piston rods 6 toward their retracted positions and results in uniform stretching of the fabric F in all directions. As the tensional stress upon the filaments of the fabric F increases, the tongs 12 are lifted off the respective bases 23 (see FIG. 3) and enable the universal joints 9 to permit changes of orientation of the respective tongs, i.e., each of the closed tongs can assume an optimum orientation for uniform stretching of the clamped portion of the fabric F and for uniform tensioning of the filaments between the respective pairs of pads 14, 15. As they move toward the respective cylinders 5, the closed tongs 12 cause the stretched fabric F to overlie the upper side 36 or 36' of the selected frame 34 or 34' preparatory to affixing of the stretched fabric to the frame. Once the affixing step is completed (the manner of affixing a stretched fabric to a frame to form a stencil is known and forms no part of the present invention), the admission of pressurized fluid into the cylinders 5 (in a sense to retract the respective piston rods 6) is interrupted, the tensional stress upon the marginal portions of the properly affixed fabric F is terminated and the tongs 12 are opened in response to manipulation of the handles 21 so that the finished stencil can be lifted off the locating surfaces 29 of the fixed carriers 28. Such lifting of the finished stencil can take place subsequent to retraction of the mobile carriers 31 away from the adjacent carriers 28.

The apparatus of FIG. 4 is then ready to receive a fresh frame 34 or 34' and to proceed with the next fabric stretching and stencil forming operation.

It goes without saying that the apparatus further comprises means for synchronizing the movements of the piston rods 6, particularly the movements of such piston rods to their retracted positions. This involves the utilization of suitable pressure regulating and synchronizing units which are not shown in the drawing. Such pressure regulating and synchronizing units can be designed to select and to vary the pressure differential between the two chambers of each cylinder 5. An advantage of the just mentioned units is that breakage of filaments which are clamped and tensioned by a particular pair of pads 14, 15 does not entail an abrupt retraction of the respective piston rod, i.e., the respective fluid-operated motor then acts as a means for damping the movement of the corresponding tongs 12 in a direction away from the portion 38 of the top surface 35' of the holder 35. The extent and/or the speed of movement of each piston rod 6 to the retracted position can be the same. Alternatively, the aforementioned pressure regulating and synchronizing unit can be designed to ensure that retraction of piston rods 6 is terminated when each piston rod encounters a predetermined resistance to further stretching of the fabric.

An advantage of the securing means 3 is that the cylinders 5 are free to turn about the axes of the respective pivot members 4 to thus ensure that the axes of the piston rods 6 can move into the planes of the vectors of tensioning forces acting upon the respective portions of a fabric F which is in the process of being stretched. This reduces the likelihood of a change of orientation of the fabric which overlies a selected frame as well as the likelihood of tearing of the fabric adjacent the closed tongs 12.

The bases 23 exhibit the advantage that the tongs 12 are invariably located at an optimum level above the top surface 35' prior to closing of their jaws 13, 16 and resulting clamping of a portion of the fabric F. Such positioning of the tongs 12 at a predetermined level above the top surface 35' facilitates more uniform clamping and tensioning of the fabric. The sloping portions 24 of the top surfaces 24+25 of the bases 23 facilitate predictable movements of the tongs 12 to levels at an optimum distance from and above the top surfaces 35' of the holder 35. The combined guiding and centering means 26, 27 also contribute to optimal positioning of the tongs 12 preparatory to closing and resulting clamping engagement of their jaws 13, 16 with the adjacent marginal portions of a fabric F. It will be seen that each stretching device comprises means (including the pivot member 4 for the cylinder 5, the base 23 with its horizontal surface portion 25, the inclined surface portion 24 of the base 23, the universal joint 9 and the combined guiding and centering means 26, 27) for ensuring optimal positioning of the tongs 12 preparatory to closing with attendant beneficial effect upon the stretching and tensioning action while the piston rods 6 are caused to move toward their retracted positions. Each of the tongs 12 can be moved about three crossing axes to invariably ensure an optimal positioning relative to the frame 34 or 34' on the locating surfaces 29 prior to start of a stretching operation.

The pivot members 4 enable the piston rods 6 to turn about horizontal axes during movement toward extended positions, i.e., during movement of the tongs 12 along the surfaces 24, 25 of the respective bases 23, and the universal joints 9 enable the tongs 12 to change their orientation relative to the respective piston rods 6. The joints 9 enable the fabric-engaging surfaces of the pads 14, 15 of closed tongs 12 to move into planes including the vectors of forces which the jaws 13, 16 transmit to the adjacent portions of the fabric F in the course of a stretching operation. The ability of tongs 12 to change their orientation relative to the corresponding piston rods 6 further reduces the likelihood of changes of orientation of the fabric during stretching and hence the likelihood of tearing of the fabric during tensioning of its filaments.

The fixed frame carriers 28 cooperate with the mobile frame carriers 31 to ensure predictable and optimal positioning of a selected frame (such as 34, or 34') so that the frame maintains its optimum position during the application and subsequent stretching and affixing of a fabric F. The mobile frame carriers 31 constitute optional but desirable and advantageous features of the improved stretching devices. These mobile carriers are particularly useful in the event of tearing of filaments of a fabric which is in the process of being stretched because the carriers 31 then ensure that the corresponding stretching device or devices remain coupled to the frame which is surrounded by the locating surfaces 30.

The aforediscussed selection of the distances of the surface portion 25 and top surface 36 or 36' of a frame from the top surface 35' of the holder 35 invariably ensures that the marginal portions of a fabric F which is being stretched will be flexed over the outermost portions of the upper side 36 or 36' of the selected frame 34 or 34' which is desirable for proper affixing of the stretched fabric to the frame.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A device for stretching a fabric upon a frame for use in a screen printing machine, comprising a support; a fluid-operated motor having a cylinder, a piston rod reciprocably extending into said cylinder, and means for moving said piston rod in at least one direction to draw the piston rod into said cylinder; means for securing said motor to said support; tongs carried by and reciprocable with said piston rod and including first and second fabric-engaging jaws; and means for mounting said tongs for automatic alignment with a force on fabric engaged by said jaws, including an universal joint between said piston rod and said tongs.

2. The device of claim 1, wherein said support defines a supporting surface and said cylinder includes a first end portion from which said piston rod extends and a second end portion, said securing means being located at the second end portion of said cylinder and defining for said motor a pivot axis which is substantially normal to said piston rod and is substantially parallel to said supporting surface.

3. The device of claim 1, wherein said piston rod is reciprocable between an extended position and a retracted position; and further comprising a base which supports said tongs in the extended position of said piston rod.

4. The device of claim 3, wherein said base is rigid with said support.

5. The device of claim 4, wherein said support includes a supporting surface and said base has a top surface including a portion which slopes toward said supporting surface in a direction toward said cylinder.

6. The device of claim 3, wherein said base and said tongs have confronting surfaces including means for guiding and centering said tongs during movement of said piston rod to said extended position.

7. The device of claim 1, wherein said first jaw includes a first fabric-engaging portion having a first elasticity and said second jaw includes a second fabric-engaging portion having a greater second elasticity.

8. The device of claim 7, further comprising means for opening and closing said tongs, said first fabric-engaging portion comprising at least one projection which deforms said second fabric-engaging portion in response to closing of said tongs.

9. The device of claim 8, wherein said at least one projection comprises an elongated rib.

10. The device of claim 1, wherein each of said jaws has two substantially parallel lateral marginal portions which make oblique angles with the axis of said piston rod.

11. The device of claim 1, wherein said support includes a frame carrier, said piston rod being reciprocable between an extended and a retracted position and said tongs being located between said securing means and said carrier in the extended position of said piston rod.

12. The device of claim 11, wherein said carrier includes means for locating a frame preparatory to stretching of a fabric by said jaws in response to movement of said piston rod toward said retracted position.

13. The device of claim 11, further comprising a mobile second frame carrier and means for releasably affixing said second carrier to said support in a selected position relative to the carrier of said support.

14. The device of claim 11, wherein said support has an underside and said carrier includes means for locating a frame preparatory to stretching of a fabric over an upper side of the frame which engages said locating means at a first distance from said underside; and further comprising a base which supports said tongs in the extended position of said piston rod, and means for closing and opening said tongs by moving at least one of said jaws relative to the other jaw to and from a plane in which said jaws abut one another while said base supports said tongs, said plane being disposed at a lesser second distance from said underside.

15. The device of claim 1, wherein said piston rod is reciprocable between a retracted position and an extended position in which a fabric is insertable in said jaws preparatory to stretching of the fabric; and further comprising means for guiding said tongs during movement of said piston rod to said extended position so that, upon arrival of said piston rod at said extended position, said tongs assume a predetermined starting position for stretching of the fabric.

16. Apparatus for making stencils of the type having a frame and a stretched fabric mounted on said frame for controlled penetration by ink in a screen printing machine, comprising a holder having an upper side; and a plurality of stretching devices mounted at and surrounding a frame-receiving portion of said upper side, each of said devices comprising a support having an underside on said upper side, a fluid-operated motor having a cylinder, a piston rod reciprocably extending into said cylinder and means for moving said piston rod in at least one direction to draw the piston rod into said cylinder and away from said portion of said upper side, tongs carried by and reciprocable with said piston rod and including first and second fabric-engaging jaws, and means mounting of said tongs for automatic alignment with a force on fabric engaged by said jaws including a universal joint provided between said piston rod and said tongs.

17. The apparatus of claim 16, wherein said frame-receiving portion of said upper side is rectangular.

18. The apparatus of claim 16, wherein said stretching devices include at least two neighboring devices and the jaws of the tongs of said at least two neighboring devices have immediately adjacent lateral marginal portions.

19. The apparatus of claim 16, further comprising means for maintaining the supports of said stretching devices in predetermined positions with reference to said holder.

20. The apparatus of claim 16, wherein said devices form plural rows including two pairs of parallel rows.

21. The device of claim 16, wherein each of said tongs has two substantially parallel lateral marginal portions which make oblique angles with the axis of the respective piston rod, said stretching devices including two neighboring devices arranged such that a lateral marginal portion of the tongs of one of said neighboring devices is immediately adjacent a lateral marginal portion of the tongs of the other of said neighboring devices.

22. The device of claim 16, wherein each of said piston rods is reciprocable between a retracted position and an extended position in which a fabric is insertable in the respective jaws preparatory to stretching of the fabric, each of said devices further comprising means for guiding the respective tongs during movement of the respective piston rod to its extended position so that, upon arrival of a piston rod at its extended position, the respective tongs assume a predetermined starting position for stretching of the fabric.

* * * * *